United States Patent [19]

Lewin

[11] 4,262,326

[45] Apr. 14, 1981

[54] LENS FOR HIGH INTENSITY LAMP FIXTURES

[75] Inventor: Ian Lewin, Scottsdale, Ariz.

[73] Assignee: K-S-H, Inc., St. Louis, Mo.

[21] Appl. No.: 21,067

[22] Filed: Mar. 16, 1979

[51] Int. Cl.[3] ..... F21V 5/02

[52] U.S. Cl. ..... 362/223; 362/225; 362/311; 362/333

[58] Field of Search ..... 362/223, 225, 260, 308, 362/309, 311, 326, 327, 328, 329, 330, 332, 335, 336, 337, 338, 339, 340, 217, 222, 224, 244, 245; 250/364

[56] References Cited

U.S. PATENT DOCUMENTS

| | | | |
|---|---|---|---|
| 2,887,568 | 5/1959 | Franck | 362/336 |
| 3,239,661 | 3/1966 | Wince et al. | 362/223 |
| 3,259,739 | 7/1966 | Guth | 362/217 |
| 3,502,865 | 3/1970 | Matteson | 250/364 |
| 3,600,569 | 8/1971 | Matteson | 362/311 |
| 3,647,148 | 3/1972 | Wince | 362/223 |
| 3,681,591 | 8/1972 | Loch | 362/217 |

OTHER PUBLICATIONS

Holophane Brochure HL-297 "Holophane Multilume Modular 2'×2' HID Luminaires" Johns Manville Sales Corp. 4-76.

*Primary Examiner*—Donald A. Griffin
*Assistant Examiner*—Alan Mathews
*Attorney, Agent, or Firm*—Polster, Polster and Lucchesi

[57] ABSTRACT

A lighting system for providing aesthetic and energy efficient lighting, for building interiors and exterior lighting, includes lighting fixtures including a high intensity discharge lamp and a novel lens. The lens is formed as a dropped square pyramid with four triangular lower panels and four generally vertical side walls. Prisms on the inner and outer faces of the lens produce a higher luminous intensity at an angle of about 30° to 50° than at nadir and project light at higher angles toward the corners of the lens than perpendicular to the sides of the lens, thereby producing a generally square, widespread light distribution pattern. The lens cuts off high angle light (with respect to nadir), thereby reducing glare.

13 Claims, 12 Drawing Figures

LENS FOR HIGH INTENSITY LAMP FIXTURES

BACKGROUND OF THE INVENTION

This invention relates to a lighting system, and to lighting fixtures incorporating novel lenses for use in the lighting system. The invention is particularly, but not exclusively, concerned with a dropped pyramidal lens used with a high intensity light source such as a high intensity discharge (HID) lamp for providing improved illumination of building interiors. The invention is also usable with other light sources and may also be used for lighting outdoor areas.

In lighting interior areas, a major consideration is the producing of required lighting levels using as little energy as possible and as little lighting equipment as possible. Thus, the use of light sources having a high efficacy, in terms of lumens per watt, is very desirable. For this reason, fluorescent lamps have become widely used in place of incandescent lamps. Fluorescent lamps, however, have two disadvantages as compared with HID lamps. First, while their efficiency is high, it is not so high as many available HID lamps. Second, fluorescent lighting fixtures are bulky and because of the low lumen output of the lamps, many fixtures are required to light an area to commonly required illumination levels.

The use of HID lamps, therefore, is to be preferred, but two disadvantages of these lamps must be overcome before their widespread use becomes adopted. The first problem is that of glare. Because of the very large amount of light emitted from a relatively small area, the amount of glare can be extremely high if not controlled by proper optical means. The second problem is that because of the very high output, only a small number of luminaires are required in order to produce normal footcandle levels, and thus these luminaires will be spread far apart. Wide spacing of luminaires tends to produce large areas of darkness between the luminaires, with very high footcandle levels beneath them. The light emitted must therefore be spread to give a broad coverage on the working surface, and yet not be so broad that concentrated light is emitted close to the horizontal, causing glare. Presently known HID lighting fixtures do not adequately resolve these problems and do not provide acceptable indoor lighting.

SUMMARY OF THE INVENTION

One of the objects of this invention is to provide a HID lighting system which provides relatively uniform light distribution throughout a space lighted by a plurality of lighting fixtures.

Another object is to provide such a system with high spacing-to-mounting height ratios.

Another object is to provide such a system which reduces direct glare.

Another object is to provide a lighting fixture and a light-transmitting lens for use in such a lighting system.

In accordance with this invention, generally stated, a lighting system is provided in which HID lighting fixtures have lenses which produce a relatively small candlepower at angles close to the vertical (nadir), and which increase the candlepower with increasing angle from nadir until approximately 30°–40° where the candlepower becomes maximum. At angles above approximately 40°, the candlepower is sharply reduced to reduce direct glare. As measured in a horizontal plane beneath each lighting fixture, the luminous intensity produced by the lens reaches a maximum at a higher angle from nadir along a line directed toward each corner of the rectangular lens than along a line perpendicular to an outer edge of the lens. Therefore, the light pattern produced by each lighting fixture is generally rectangular. The fixtures are particularly well suited for lighting interior spaces but may also be used in lighting outdoor areas, such as parking lots and service station canopy areas, where uniform lighting is desirable.

The luminaire of the invention comprises a housing, means in the housing for mounting a high intensity lamp, and a lens extending below the housing. The lens comprises a dropped rectangular pyramid having four generally vertical side panels and four generally triangular lower panels, all of the panels having prisms on their inner faces and on their outer faces, the prisms comprising means for producing a substantially higher luminous intensity in all lateral positions in a direction away from nadir than at nadir, and for producing maximum luminous intensity at a smaller angle to nadir in a lateral direction perpendicular to the sides of the lens than in a lateral direction toward the corners of the lens. This arrangement produces the rectangular lighting pattern which permits the luminaires to be spaced apart on a rectangular grid, and to produce generally even lighting levels at task level even when the ratio of spacing to mounting height is quite large, on the order of 1.8:1 or greater in both directions.

Preferably, the maximum luminous intensity is at an angle of from 25° to about 45° from nadir in a lateral direction perpendicular to each outer edge of the lens, and the maximum luminous intensity in a lateral direction toward the corners of the lens is at an angle which is 5° to 15° greater from nadir. The angle of the maximum intensity beam is maintained below about 55° in all lateral directions, to prevent direct glare. The maximum luminous intensity in a lateral direction toward the corners of the lens is preferably at an angle of from about 40° to about 50° and is at least fifty percent greater than the value of the luminous intensity at nadir.

The lens is preferably substantially square. The prisms on the outer faces of the lower panels are generally parallel to the outer edge of the panels and the prisms on the inner faces of the lower panels are generally perpendicular to the outer edges of the lower panels. The prisms on the inner faces of the lower panels comprise a central strip of prisms substantially narrower than the length of the outer edges of the lower panels, and the areas of the inner faces of the lower panels outside of the strip are generally clear. The prisms on the outer faces of the lower panels constitute means for producing a substantially higher luminous intensity in directions away from nadir than at nadir, and the prisms on the inner faces of the lower panels constitute means for increasing luminous intensity in a lateral direction toward the corners of the lens. The prisms on the outer faces of the side walls are generally horizontal and split light emitted from them into an upper beam directed upward from the lens and a lower beam directed downward from the lens at an angle of less than about 50° from nadir. This technique is known per se from U.S. Pat. No. 3,647,148 to Wince. The prisms on the inner faces of the side walls are substantially vertical and break up the image of the lamp. One or more of the surfaces of the lens may be given a slight matte finish to reduce lamp images.

A feature of note in the design is that the overall fixture height can be small. As the lens if a drop-pyramid, and as the optics are designed such that satisfactory candlepower distribution is achieved with the lamp set low in the fixture, it is unnecessary to have fixtures as deep as those in common use. This overcomes a major disadvantage of other forms of HID fixture, where the large depth normally required restrictions on their application, because of limited plenum height. Because the lens of the invention permits the lamp to be placed low in the fixture, more light rays from the lamp strike the lens directly, and the efficiency of the fixture is therefore extremely high despite its excellent light control.

The fixture itself can be of any design suitable for placing the lamp in general proximity to the lens. The lamp may be horizontal, vertical or slanted, and if horizontal, may be perpendicular or diagonal to a side of the fixture. A useful feature of the fixture is to give facilities for a variable vertical light center position to produce different light patterns. An alteration in light center in a horizontal plane also may produce useful variations in light distribution. The inside of the fixture may have white diffusing finish, or an aluminum reflector may be inserted. The design of the reflector may be standard, or it may be designed to reduce light in a direction toward nadir, or it may be designed to compensate for asymmetry in the light distribution of an HID lamp in the manner of U.S. Pat. No. 3,259,739 to Guth.

The lamp is preferably a form of high intensity discharge lamp, but may also be another compact source such as incandescent or tungsten-halogen lamp. Although the present embodiment cannot use larger than a 400 watt lamp for thermal reasons, all principles apply equally to larger lamps, and for instance, a 1000 watt lamp could be used if the overall fixture size were increased.

The lens is preferably formed from acrylic plastic, but also may be formed from other types of plastic, or from glass. Its thickness, within reason, is not important to the optical performance.

Other features of the invention will be better understood in light of the following description of the preferred embodiment.

DESCRIPTION OF THE PREFERRED EMBODIMENT

Figure 1:
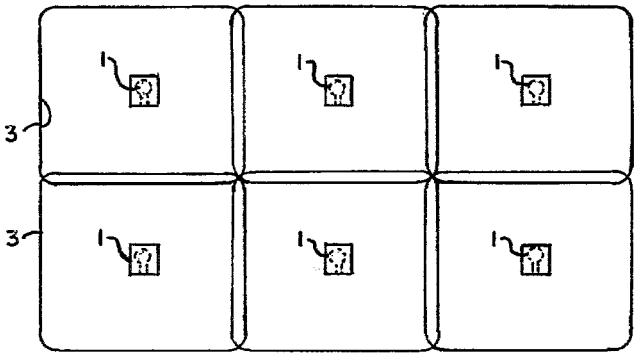
FIG. 1 is a diagrammatic plan view of a lighting system incorporating the present invention.

Referring now to the drawings, and in particular to FIG. 1, a lighting system in accordance with the present invention comprises a plurality of lighting fixtures 1 arranged in a rectangular grid. The fixtures 1 are spaced apart twelve feet in a direction parallel to the axis of the lamps mounted therein ("along") and fifteen feet in a direction perpendicular to the axes of the lamps ("across"). The fixtures are mounted ten feet above the floor, and 7.5 feet above the level of work surfaces such as desks which are on the floor. The spacing-to-mounting height ratio is therefore 1.6 in the "along" direction and 2.0 in the "across" direction, and the average spacing-to-mounting height ratio is 1.8 in both directions. The term "spacing-to-mounting height ratio" as used in the art is the ratio of the fixture spacing, measured along one axis of a rectangular grid, to the height of the fixtures above work surfaces at which light is to be utilized. The work surfaces are generally taken to be nominally thirty inches above the floor.

As shown diagrammatically in FIG. 1, the light distribution 3 of the fixtures 1 is generally rectangular. Therefore, the amount of light at working level throughout the area lighted by the fixture 1 is relatively uniform.

Figure 2:
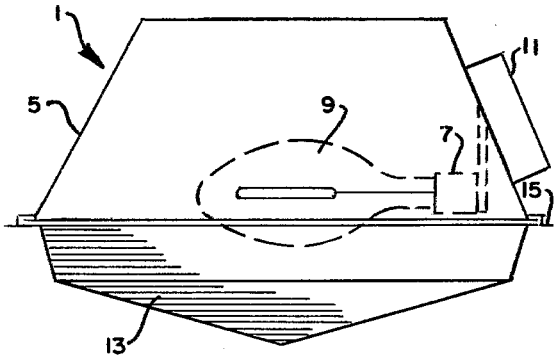
FIG. 2 is a view in side elevation of a luminaire of the present invention incorporating a lens of the present invention.

As shown in FIG. 2, each fixture 1 consists of a housing 5 in which is mounted a socket 7 for a high intensity discharge lamp 9, a ballast 11 and a depending lens 13. The fixture 1 may be mounted in a ceiling structure 15 of a building or other interior space. The sides of the housing 5 are tapered upwardly inward. As illustrated, the housing 5 is ten inches tall, 23½ inches square at its lower end and 9½ inches square at its top. The interior of the housing 5 is coated with a highly reflective white paint.

The lens 13 is in the form of an integral square dropped pyramid having a peripheral lip 17, four identical generally vertical side panels 19, and four identical triangular lower panels 21. The lens 13 is injection molded from acrylic plastic and has an average thickness of 0.188 inches. The lens 13 is 22⅜ inches square and has a depth of 3.854 inches. The lip 17 is horizontal and has a width of 0.500 inches. Each side panel 19 slopes inwardly at an angle of 14.5° to vertical and is 1.75 inches wide. Each of the lower panels 21 slopes downwardly from horizontal at an angle of 10.89° and is 10.438 inches wide as measured along a center line 22 from its outer edge of its (lower) apex.

Linear prisms are provided on the inner and outer faces of the side panels 19 and the lower panels 21. Each of the linear prisms is of uniform cross section throughout its length and extends from edge to edge of its panel. Together the prisms create the highly desirable widespread rectangular light distribution which is characteristic of the fixtures of the present invention.

Figure 7:
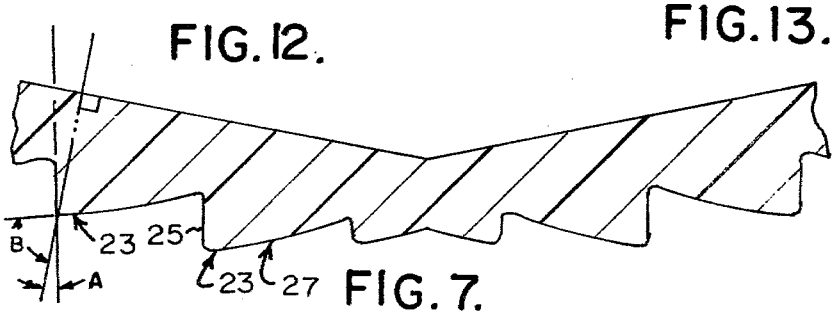
FIG. 7 is a detail of FIG. 6 showing a cross section of linear prisms on the outer face of the lower panels.
Figure 6:
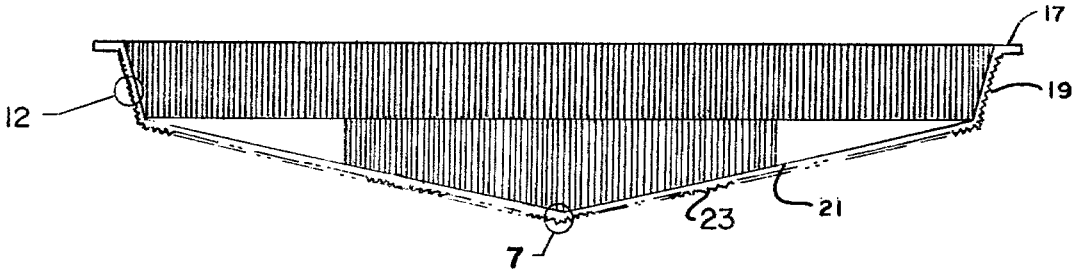
FIG. 6 is a sectional view taken along the line 6—6 of FIG. 5.
Figure 8:
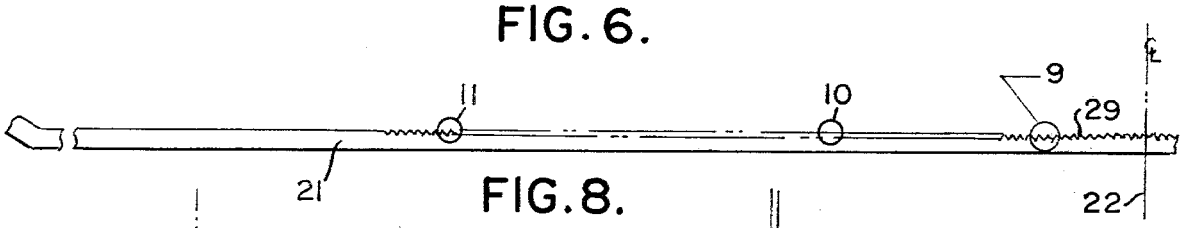
FIG. 8 is a sectional view taken along line 8—8 of FIG. 5, and showing prisms on the inner face of the bottom panels.

The outside prisms 23 on the bottom panels 21 are shown in FIG. 7. These prisms run parallel to the perimeter of the lens 13 and are each 0.125 inches wide. Each prism has a face 25 toward the periphery of the lens which forms an angle A with respect to the normal to the plane of its panel 21, and a face 27 toward the center of the lens which forms an angle B with respect to the normal to the plane of its panel 21. The faces 27 are slightly crowned (plus and minus 1°), and the corners are slightly rounded to avoid a notch effect in the optics. The values of the angles A and B are shown in the following Table 1 for each prism 23, starting with the half prism at the center of the lens:

TABLE 1

| Prism No. | Angle A | Angle B |
|---|---|---|
| 1 through 15 | 12.8 | 65.0 |
| 16 | 12.8 | 66.2 |
| 17 | 12.8 | 68.0 |
| 18 | 12.8 | 69.8 |
| 19 | 12.8 | 70.4 |
| 20 | 12.8 | 73.0 |
| 21 | 12.8 | 71.7 |
| 22 | 12.8 | 76.5 |
| 23 | 12.8 | 78.6 |
| 24 | 12.8 | 80.5 |
| 25 | 12.8 | 82.5 |
| 26 | 12.8 | 84.7 |
| 27 | 12.8 | 86.6 |
| 28 | 12.8 | 88.4 |
| 29 | — | — |
| 30 | 88.5 | 19.4 |
| 31 | 86.5 | 19.4 |
| 32 | 84.5 | 20.7 |
| 33 | 82.5 | 20.7 |
| 34 | 80.5 | 21.7 |
| 35 | 78.5 | 21.7 |
| 36 | 76.7 | 23.1 |
| 37 | 75.0 | 23.1 |
| 38 | 73.4 | 23.1 |
| 39 | 71.8 | 24.7 |
| 40 | 70.3 | 24.7 |
| 41 | 68.8 | 24.7 |
| 42 | 67.4 | 25.9 |
| 43 | 66.1 | 25.9 |
| 44 | 64.9 | 25.9 |
| 45 | 63.7 | 27.0 |
| 46 | 62.6 | 27.0 |
| 47 | 61.3 | 27.0 |
| 48 | 60.2 | 28.3 |
| 49 | 59.2 | 28.3 |
| 50 | 58.2 | 28.3 |
| 51 & 52 | 57.0 | 29.9 |
| 53 through 55 | 55.0 | 29.9 |
| 56 through 58 | 53.2 | 31.3 |
| 59 & 60 | 51.8 | 31.3 |
| 61 & 62 | 50.5 | 32.6 |
| 63 through 65 | 48.7 | 32.6 |
| 66 through 68 | 46.9 | 32.6 |
| 69 through 71 | 45.2 | 33.6 |
| 72 through 74 | 44.0 | 33.6 |
| 75 through 77 | 42.7 | 34.3 |
| 78 through 80 | 42.0 | 34.3 |
| 81 through 83 | 41.3 | 35.1 |
| 84 & 85 | 40.4 | 35.1 |

The prisms 23 on the outer faces of the lower panels 21 from the main beam of the candlepower. The incident ray upon a given prism will fall an angle different from the other prisms. The angle of the prism changes to compensate for this effect, such that the emitted ray always will exit at the same general vertical angle. There is a departure from this principle for prisms 1 through 15, which have a constant face angle. At these points, refractive effects are unable to create enough deviation of the incoming rays (which are close to the vertical) to place them in the main beam, without the creation of a high brightness patch due to inter-reflection within deep prisms. The constant and moderate angle of these prisms eliminates this hot spot for better appearance, yet prevents ray from being emitted directly at nadir.

For aesthetic purposes, a slight diffusion of texturing is added to a part of the surface of the outside bottom panel 21. Toward the lower apexes of the panels 21, the outside surface is optically clear, and the texturing is gradually increased toward the perimeter of the lens 13. This produces a uniform brightness and attractive appearance. The diffusion is added only to desired areas, and not to areas where diffusion may cause high angle light emission and glare.

Figure 9:
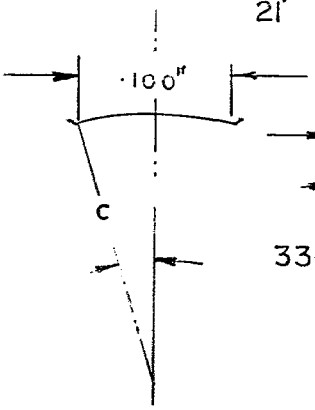
FIG. 9 is a detail of FIG. 8 showing a central prism of the prisms on the inner face of a lower panel.

The inside prisms 29 on the bottom panels are shown in FIGS. 8—11. These prisms run perpendicular to the perimeter of the lens 13 and are each 0.100 inches wise. The prisms 29 are arranged symmetrically with respect to the center line 22 of each panel 21. The prisms 29 are of three types. As shown in FIG. 9, from the center line 22 of each panel 21, the first seventeen prisms 29 are in the form of lenticules having a radius of curvature C. The radius C (in inches) for each of the first 17 prisms 29 is shown in the following Table 2:

TABLE 2

| Prism No. | Radius C |
|---|---|
| 1 through 10 | .193 |
| 11 | .181 |
| 12 | .171 |
| 13 | .154 |
| 14 | .140 |
| 15 | .128 |
| 16 & 17 | .123 |

Figure 10:
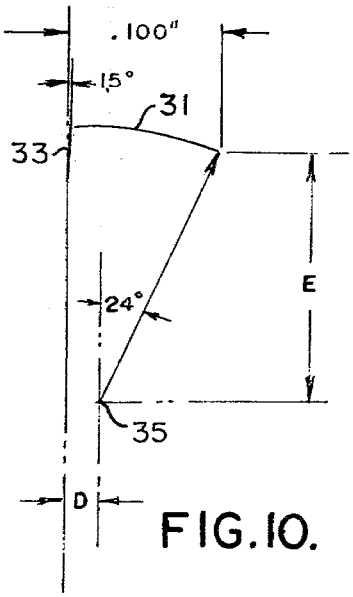
FIG. 10 is a detail corresponding to FIG. 9 showing an intermediate prism thereof.

As shown in FIG. 10 the eighteenth through twenty-five of the prisms 29 have a curved face 31 toward the center line 22 and a plane face 33 toward the perimeter of the lens. The face 31, in cross-section, is a segment of a circle having its center 35 spaced a distance D in the plane of the face 21 inwardly from the outer edge of the prism 29, and a distance E perpendicular to the plane of the panel 21 from the inner edge of the prism 29. The angle between the line through the center 35 and the inner edge of the prism 29 and the line through the center 35 perpendicular to the plane of the panel 21 is 24° for all of the prisms eighteen through twenty-five. The faces 33 of these prisms 29 are all inclined 1.5° inward from normal to the plane of the panel 21. The values of the variables D and E (in inches) for each of the eighteenth through twenty-fifth of the prisms 29 are shown in the following Table 3:

TABLE 3

| Prism No. | "D" | "E" |
|---|---|---|
| 18 & 19 | .037 | .140 |
| 20 & 21 | .025 | .168 |
| 22 & 23 | .012 | .196 |
| 24 & 25 | .000 | .225 |

Figure 11:
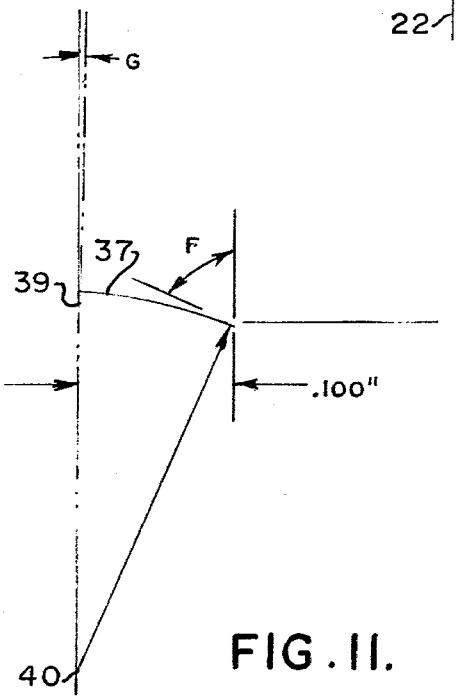
FIG. 11 is a detail corresponding to FIGS. 9 and 10 showing an outboard prism thereof.

The twenty-sixth through fiftieth of the prisms 20 are formed similarly to the foregoing prisms, with curved inner faces 37 and plane outer faces 39. These prisms 29 are shown in FIG. 11. At the inner edge of each curved face 37, the face 37 forms an angle F with respect to the normal to the plane of the panel 21. The center of curvature 40 of the face 37 is along a line normal to the plane of the panel 21 through the outer edge of the prism 29, and is spaced a distance from the face 37 equal in inches to one tenth the secant of the angle F. The faces 39 are inclined inward an angle G with respect to the normal to the plane of the panel 21. The values of the variables F and G (in degrees) are given in the following Table 4:

TABLE 4

| Prism No. | "F" | "G" |
|---|---|---|
| 26 & 27 | 68.0 | 1.5 |
| 28 & 29 | 70.0 | 1.5 |
| 30 & 31 | 72.0 | 1.5 |
| 32 & 33 | 74.5 | 1.5 |
| 34 & 35 | 77.0 | 2.5 |
| 36 & 37 | 79.5 | 4.5 |
| 38 & 39 | 82.0 | 6.5 |
| 40 & 41 | 84.0 | 8.5 |
| 42 & 43 | 86.0 | 10.5 |
| 44 & 45 | 87.5 | 12.5 |
| 46 through 50 | 88.5 | 14.5 |

The purpose of the inside bottom prisms 29 is to create the required lateral spaced of the light rays, and to assist in the creation of a uniform light pattern in a lighting system. To produce the light distributions of FIG. 1 and FIG. 3, the lens must produce the maximum candlepower in a direction which strikes the workplane approximately 7.5 ft. from the luminaire measured horizontally in the across-axis plane and six feet in the along-axis plane, to fill the otherwise dark area. In terms of light distribution in a plane diagonal to the fixture, however the effective spacing is 19.2 ft. The maximum candlepower along the horizontal thus should be directed to points approximately 9.6 ft. from the unit. This requires that the angle of the maximum candlepower in the diagonal plane be elevated with respect to that in the across or along plane.

The four beam-forming bottom panels are broadside of the across- and along-axis directions, and the strongest light producing panels will be those having outside prisms running parallel to the lamps because the lamp produces its highest candlepower perpendicular to its axis. Thus, some light must be removed from the across axis plane and aimed along the diagonal to fill the void at the center of the square formed by four units.

The inside bottom prisms thus have two purposes: to swing some rays laterally away from the across axis plane, and to elevate those rays prior to emission at angles close to the diagonal.

It will be seen that the prisms 29 range from gently rounded flutes close to the center line which create diffusion and break up the lamp image without greatly redirecting the light, to prisms which swing the rays to the diagonal direction. The prisms are rounded, both to create a lateral angle shift as required and also to spread the exiting rays over an angular range for improved aesthetics. The prisms gradually are reduced until they phase out completely five inches from the center line 22.

An important feature of the performance of the prisms 29 is that an observer can view the lens directly from a variety of lateral angles and see similar brightness. Thus as he walks around a fixture, the effect of a hot spot "following" him is minimized.

A slight texturing is provided on the entire surfaces of the panels 21.

Figure 12:
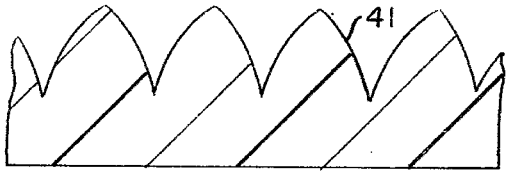
FIG. 12 is a detail of FIG. 6 showing a cross section of linear prisms on the outer face of a side panel.

The prisms 41 on the outside of the side panels 19 are shown in FIG. 12. These prisms run parallel to the perimeter of the lens 13 and are each 0.100 inches wide. The prisms 41 are identical and symmetrical. The faces of the prisms slope 27° with respect to the normal to the plane of the side panel. The faces are convexly rounded plus and minus 1°, for the purpose of spreading light emitted from them. These prisms split the light passing through them into a lower beam which enlarges the main beam of the lens, and an upper beam which lights the ceiling structure around the fixture 3. The upwardly directed light relieves contrast between the fixtures and the surrounding ceiling and provides useful reflected light from the ceiling.

The outside surfaces of the side walls 19 are textured to diffuse the lamp image.

Figure 13:
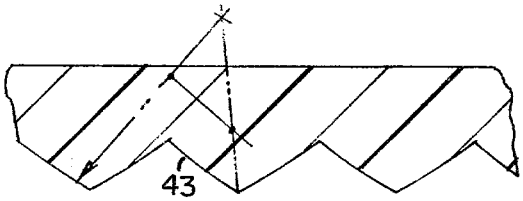
FIG. 13 is a detail showing sections of prisms on the inner face of a side panel of the lens.

The prisms 43 on the inside of the side panels 19 are shown in FIG. 13. These prisms run perpendicular to the perimeter of the lens 13 and are each 0.100 inches wide. The prisms 43 are identical and symmetrical. Each face, in cross-section, is formed as a segment of a circle having a radius of 0.224 inches and a center of curvature on a line perpendicular to the plane of the panel 19 and extending through the apex of the adjoining prism. These deep rounded prisms are used to completely break up lamp images for improved appearance.

Figure 3:
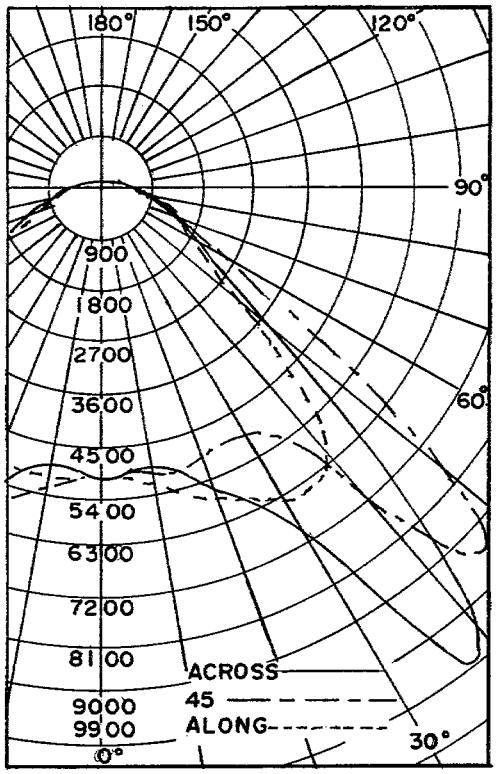
FIG. 3 is a light distribution (luminous intensity) diagram of the fixture shown in FIG. 2, as measured in a lateral direction perpendicular to one edge of the lens (across), as measured perpendicular to an adjacent edge of the lens (along), and as measured in a lateral direction toward a corner of the lens (45°)
Figure 4:
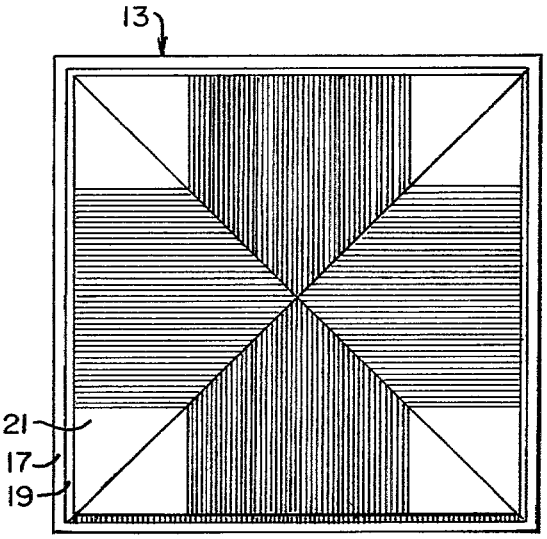
FIG. 4 is a somewhat diagrammatic top plan view of the lens shown in FIG. 2.
Figure 5:
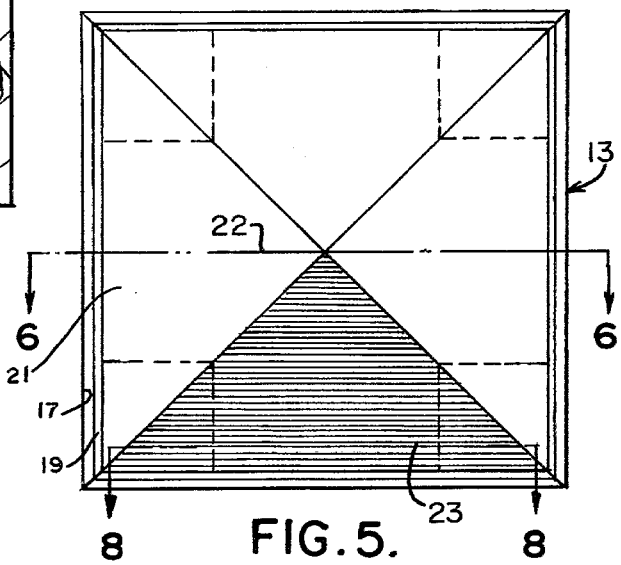
FIG. 5 is a somewhat diagrammatic bottom plan view of the lens of FIG. 4.

The fixture of the preferred embodiment has been found to produce an efficiency in excess of 75% when the reflective paint in the fixture housing has a reflectance of 0.85 and the lamp is a 250 watt, clear high pressure sodium lamp rated at 27,500 lumens, with its axis spaced 8.625 inches from the top of the fixture. The light distribution from the fixture is shown in FIG. 3 and in the following Table 5:

TABLE 5

| | CANDLEPOWER DATA | | | | | |
|---|---|---|---|---|---|---|
| | | PLANE | | | | OUTPUT |
| ANGLE | ACROSS | 67.5 | 45 | 22.5 | ALONG | LUMENS |
| 0 | 5239 | 5239 | 5239 | 5239 | 5239 | |
| 5 | 5112 | 5133 | 5194 | 5259 | 5287 | 498 |
| 10 | 5049 | 5061 | 5214 | 5415 | 5504 | |
| 15 | 5278 | 5147 | 5235 | 5632 | 5780 | 1523 |
| 20 | 5664 | 5319 | 5122 | 5676 | 5910 | |
| 25 | 6254 | 5613 | 5100 | 5874 | 6228 | 2644 |
| 30 | 7032 | 6019 | 5079 | 5984 | 6495 | |
| 35 | 9458 | 7250 | 5422 | 5851 | 6495 | 4211 |
| 40 | 10447 | 9456 | 7097 | 5562 | 6136 | |
| 45 | 6852 | 8251 | 9257 | 4652 | 4665 | 5127 |
| 50 | 3796 | 5038 | 7852 | 3373 | 3034 | |
| 55 | 2462 | 2910 | 4407 | 2338 | 2080 | 2882 |
| 60 | 1879 | 1995 | 2399 | 1739 | 1600 | |
| 65 | 1529 | 1553 | 1640 | 1390 | 1306 | 1539 |
| 70 | 1284 | 1282 | 1306 | 1159 | 1103 | |
| 75 | 1046 | 1053 | 1044 | 945 | 894 | 1067 |
| 80 | 844 | 842 | 801 | 746 | 710 | |
| 85 | 658 | 663 | 645 | 563 | 538 | 678 |
| 90 | 496 | 519 | 495 | 424 | 393 | |
| 95 | 349 | 331 | 311 | 266 | 273 | 347 |
| 100 | 212 | 201 | 194 | 153 | 158 | |
| 105 | 164 | 160 | 171 | 115 | 113 | 159 |
| 110 | 158 | 135 | 151 | 88 | 104 | |
| 115 | 144 | 124 | 115 | 72 | 88 | 104 |
| 120 | 131 | 104 | 70 | 56 | 74 | |
| 125 | 104 | 77 | 5 | 41 | 59 | 46 |
| 130 | 61 | 29 | 0 | 16 | 34 | |
| 135 | 7 | 0 | 0 | 0 | 2 | 4 |
| 140 | 0 | 0 | 0 | 0 | 0 | |
| 145 | 0 | 0 | 0 | 0 | 0 | 0 |
| 150 | 0 | 0 | 0 | 0 | 0 | |
| 155 | 0 | 0 | 0 | 0 | 0 | 0 |
| 160 | 0 | 0 | 0 | 0 | 0 | |
| 165 | 0 | 0 | 0 | 0 | 0 | 0 |
| 170 | 0 | 0 | 0 | 0 | 0 | |
| 175 | 0 | 0 | 0 | 0 | 0 | 0 |
| 180 | 0 | 0 | 0 | 0 | 0 | |

In a system as shown in FIG. 1, in which the average spacing-to-mounting height ratio is 1.8, the ratio of maximum-to-minimum horizontal footcandles at working level is less than 1.5.

Numerous variations in the lighting system, fixture and lens of the present invention, within the scope of the appended claims, will occur to those skilled in the art in view of the foregoing disclosure. Merely by way of example, in addition to the variations previously mentioned, the fixtures may be spaced differently and mounted at different heights. The fixture housing and lamp may be altered widely. The shape of the lens and the size and shapes of the prisms can be altered. These variations are merely illustrative.

I claim:

1. A lighting fixture comprising a housing, means in the housing for mounting a high intensity lamp, and a lens extending below the housing, characterized in that the lens comprises a dropped rectangular pyramid having four generally vertical side panels and four generally triangular lower panels, all of said panels having prisms on their inner faces and on their outer faces, said prisms comprising means for producing a substantially higher luminous intensity in all lateral positions in a direction away from nadir than at nadir, and for producing maximum luminous intensity at a smaller angle to nadir in a lateral direction perpendicular to the sides of the lens than in a lateral direction toward the corners of the lens.

2. The fixture of claim 1 wherein said maximum luminous intensity is at an angle of from 25° to about 45° from nadir in a lateral direction perpendicular to each outer edge of said lens, and wherein said maximum luminous intensity in a lateral direction toward the corners of said lens is at an angle which is 5° to 15° greater from nadir than the maximum luminous intensity in said lateral directions perpendicular to said outer edges.

3. The fixture of claim 2 wherein the angle of said maximum luminous intensity does not exceed 55° in any lateral direction and does not fall below 25° in any lateral direction.

4. The fixture of claim 3 wherein the maximum luminous intensity in a lateral direction toward the corners of said lens is at an angle of from about 40° to about 50° and is at least 50% greater than the value of the luminous intensity at nadir.

5. The fixture of claim 2 wherein the lens is substantially square and the prisms on the outer faces of the lower panels are generally parallel to the outer edge of the panels and the prisms on the inner faces of the lower panels are generally perpendicular to the outer edges of the lower panels.

6. The fixture of claim 5 wherein the prisms on the inner faces of the lower panels comprise a central strip of prisms substantially narrower than the length of the outer edges of the lower panels, the area of the inner faces of the lower panels outside of said strip being generally clear.

7. The fixture of claim 6 wherein the prisms on the outer faces of said side walls are generally horizontal and the prisms on the inner faces of said side walls are substantially vertical.

8. A lens for us in a lighting fixture below a high intensity lamp, the lens comprising a dropped rectangular pyramid having four generally vertical side panels and four generally triangular lower panels, all of said panels having prisms on their inner faces and their outer faces, said prisms comprising means for producing a substantially higher luminous intensity in directions away from nadir than at nadir and for producing maximum luminous intensity at a smaller angle to nadir in a direction perpendicular to the sides of the lens than in a direction toward the corners of the lens, the prisms on the outer faces of the lower panels being generally parallel to the outer edge of the panels and constituting means for producing a substantially higher luminous intensity in directions away from nadir than at nadir, and the prisms on the inner faces of the lower panels being generally perpendicular to the outer edges of the lower panels and constituting means for increasing luminous intensity in a lateral direction toward the corners of the lens.

9. The lens of claim 8 wherein the prisms on the inner faces of the lower panels comprise a central strip of prisms substantially narrower than the length of the outer edges of the lower panels, the area of the inner faces of the lower panels outside of said strip being generally optically clear.

10. The fixture of claim 6 wherein the prisms on the outer faces of said side walls are generally horizontal and split light emitted from them into an upper beam directed upward from the lens and a lower beam directed downward from the lens at an angle of less than about 50° from nadir, and wherein the prisms on the inner faces of said side walls are substantially vertical and constitute means for increasing luminous intensity in a lateral direction toward the corners of the lens.

11. A lighting system comprising a plurality of lighting fixtures arranged in a rectangular pattern, each of said lighting fixtures including a high intensity light source and a lens, said lens comprising a dropped rectangular pyramid having four generally vertical side panels and four generally triangular lower panels, said panels having prisms on their inner faces and on their outer faces, said prisms comprising means for producing a substantially higher luminous intensity in all lateral positions in a direction away from nadir than at nadir, and for producing maximum luminous intensity at a smaller angle to nadir in a lateral direction perpendicular to the sides of the lens than in a lateral direction toward the corners of the lens, the light pattern produced by each lighting fixture being thereby generally rectangular.

12. The lighting system of claim 11 wherein said system produces lighting levels at task level which have a ratio of maximum to minimum footcandles of less than 1.5, when the average ratio of spacing to mounting height is on the order to 1.8:1 or greater in both directions.

13. The lighting system of claim 11 wherein, in a lateral direction perpendicular to an edge of said lens, said lens produces a relatively small candlepower at angles close to nadir, increases the candlepower with increasing angle from nadir until approximately 30°–40°, and sharply reduces candlepower at angles above approximately 40°.

* * * * *

UNITED STATES PATENT AND TRADEMARK OFFICE

CERTIFICATE OF CORRECTION

PATENT NO. : 4,262,326

DATED : April 14, 1981

INVENTOR(S) : Ian Lewin

It is certified that error appears in the above—identified patent and that said Letters Patent is hereby corrected as shown below:

Column 2, line 68, "if" should be "is".

Column 3, line 6, "required restrictions" should be "required places restrictions".

Column 4, line 58, "of its" should be "to its".

Column 5, line 56, "from" should be "form".

Column 6, line 3, "of" should be "or".

Column 6, line 14, "wise" should be "wide".

Column 6, line 32-33, "twenty-five" should be "twenty-fifth".

Column 6, line 57, "20" should be "29".

Column 7, line 17, "spaced" should be "spread".

Column 7, line 65, "27°" should not be in boldface type.

Column 9, line 59, "us" should be "use".

Signed and Sealed this

*Twenty-third* Day of *February 1982*

[SEAL]

*Attest:*

GERALD J. MOSSINGHOFF

*Attesting Officer*

*Commissioner of Patents and Trademarks*